US005351832A

United States Patent [19]

Abbott et al.

[11] Patent Number: 5,351,832

[45] Date of Patent: Oct. 4, 1994

[54] CONTROL SYSTEM FOR CLEANING SYSTEMS

[75] Inventors: Kenneth E. Abbott; Patrick J. Lyons, both of Tucson, Ariz.

[73] Assignee: Stripping Technologies, Inc., Tucson, Ariz.

[21] Appl. No.: 39,722

[22] Filed: Mar. 29, 1993

[51] Int. Cl.[5] ..... B07B 4/00

[52] U.S. Cl. ..... 209/139.1; 209/142; 209/154

[58] Field of Search ..... 209/139.1, 142, 146, 209/149, 154

[56] References Cited

U.S. PATENT DOCUMENTS

| | | | |
|---|---|---|---|
| Re. 29,625 | 5/1978 | Summers . | |
| 409,258 | 8/1889 | Ward . | |
| 969,157 | 9/1910 | Day . | |
| 1,272,311 | 7/1918 | Plaisted . | |
| 2,330,793 | 9/1943 | Peebles . | |
| 2,931,500 | 4/1960 | Andren et al. . | |
| 2,959,284 | 11/1960 | Molstedt . | |
| 3,062,458 | 11/1962 | Dearing . | |
| 3,421,618 | 1/1969 | Burney et al. . | |
| 3,441,131 | 4/1969 | Gebauer . | |
| 3,539,008 | 11/1970 | McKibben | 209/234 |
| 3,842,978 | 10/1974 | Summers . | |
| 4,046,492 | 9/1977 | Inglis . | |
| 4,156,644 | 5/1979 | Richard | 209/157 X |
| 4,176,749 | 12/1979 | Wallace et al. | 209/457 |
| 4,194,971 | 3/1980 | Beeckmans | 209/467 |
| 4,195,780 | 4/1980 | Inglis . | |
| 4,216,080 | 8/1980 | Summers et al. | 209/469 |
| 4,248,702 | 2/1981 | Wallace et al. | 209/455 |
| 4,299,694 | 11/1981 | Goodell . | |
| 4,385,728 | 5/1983 | Inglis et al. . | |
| 4,411,388 | 10/1983 | Muck . | |
| 4,521,303 | 6/1985 | Hicks et al. | 209/454 |
| 4,539,103 | 9/1985 | Hollingsworth | 209/158 |
| 4,546,552 | 10/1985 | Cahn et al. . | |
| 4,589,981 | 5/1986 | Barai et al. | 209/474 |
| 4,657,667 | 4/1987 | Etkin | 209/154 X |
| 4,743,363 | 5/1988 | Darrow | 209/138 |
| 4,784,755 | 11/1988 | Taylor | 209/136 |
| 4,851,110 | 7/1989 | Rolle et al. | 209/135 |
| 4,933,072 | 6/1990 | Beisel | 209/142 |
| 5,103,981 | 4/1992 | Abbott et al. | 209/139.1 X |

FOREIGN PATENT DOCUMENTS

| | | | |
|---|---|---|---|
| 0198945 | 10/1986 | European Pat. Off. . | |
| 453358 | 12/1927 | Fed. Rep. of Germany . | |
| 1577887 | 7/1990 | U.S.S.R. | 209/154 |

*Primary Examiner*—David H. Bollinger
*Attorney, Agent, or Firm*—Ogram & Teplitz

[57] ABSTRACT

A system for cleaning or separating particles that uses a controller or computer to precisely control the cleaning or separating process. By carefully monitoring and controlling the separating process, an improved degree of separation is achieved. In the preferred embodiment, the invention controls a particle separating machine which uses upward airflow in a channel to separate less dense particles from heavier or more dense particles. Upward airflow is induced in the channel by an airflow means. A wind speed sensor measures the air velocity in the channel and communicates this data to a controller. An operator inputs targeted or desired upward air velocity to the controller. The controller commands the airflow means to increase or decrease airflow in the channel so that upward air velocity in the channel remains comparable to the targeted upward air velocity input from the operator. Particles entering the channel are separated to a high degree because of the precisely controlled airflow.

18 Claims, 3 Drawing Sheets

INITIAL ADJUSTMENTS
AND
CONTROL SETTINGS

PROCESS CONTROLLER
VELOCITY RANGES

| MESH RANGE | VELOCITY SETTING FPM |
|---|---|
| 20 - 25 | 300 - 350 |
| 25 - 38 | 225 - 275 |
| 38 - 50 | 100 - 150 |

FIG. 5

CONTROL SYSTEM FOR CLEANING SYSTEMS

BACKGROUND OF THE INVENTION

This invention relates generally to particle cleaning and separating and more specifically, this invention relates to precision monitoring and control of particle cleaning and separating machines which separate particles based upon the relative densities or weights of the particles.

The separation of a useful product from an unusable item has plagued man almost from the dawn of time. In fact, the early form of threshing wheat, using the wind to blow away the chaff, is one such solution to the problem.

As the industrialization of the world took place, the separation of particles became a more intense problem since the materials sought were needed in higher concentrations than before.

Separating a fluid mixture has posed some very unique problems. With these problems, some unique solutions have been developed such as U.S. Pat. No. 4,539,103, entitled "Hydraulic Separating Method and Apparatus" issued Sep. 3, 1985, to Hollingworth; and U.S. Pat. No. 4,176,749, entitled "Materials Separation" issued Dec. 4, 1979, to Wallace et al. In both of these inventions, the material that is to be separated is suspended in a liquid which is utilized for the extraction of the material.

Unfortunately, the abilities and expertise of liquid separators are not easily ported over to a mixture of dry material.

In attempting to solve this problem, a wide variety of fluidized beds have been developed including: U.S. Pat. No. 4,194,971, entitled "Method of Sorting Fluidized Particulate Material and Apparatus Therefor" issued Mar. 25, 1980, to Beeckmans; and U.S. Pat. No. 4,546,552, entitled "Fluid Induced Transverse Flow Magnetically Stabilized Fluidized Bed" issued Oct. 15, 1985, to Cahn et al.

In all fluidized bed separation situations, the mixture to be separated is suspended on a grate or bed while air "bubbles" through the mixture at a rate sufficient to remove a targeted particle permitting the remaining material to be swept away or to fall through the grate. Balancing the inflow of contaminated mixture to the throughput is extremely difficult. Without this control though, the mechanism does not perform optimally.

The problem of control is of such a concern that a whole group of inventions address this problem alone. One such invention is described in U.S. Pat. No. 4,248,702, entitled "Stratifier Discharge Control" issued Feb. 3, 1981, to Wallace et al.

Even though the fluidized bed concept is complex, it is far from optimal and a wide range of enhancements have been developed such as U.S. Pat. No. 4,156,644, entitled "Pulsating Sludge Bed with Inclined Plates" issued May 29, 1979, to Richard.

As the complexity of the devices have grown, so too has the down time and repair costs. To attempt to simplify the situation, some devices have attempted to revert to the simpler modes of operation, or have attempted to solve the problem in unique ways. This includes U.S. Pat. No. 4,589,981, entitled "Fluidized Bed Classifier" issued May 20, 1986, to Barari et al. and U.S. Pat. No. 4,521,303, entitled "Solids Separation in Self-Circulating magnetically Stabilized Fluidized Bed" issued Jun. 4, 1985, to Hicks et al.

In all of these apparatuses, the mechanism becomes more and more expensive to operate and acquire. This makes them less than ideal for many situations.

Perhaps the most illustrative of the techniques currently used are the ones developed to separate tobacco leaves and parts from sand. These include: U.S. Pat. No. 4,216,080, entitled "Method and Apparatus for Separating Sand from Botanical Fines" issued Aug. 5, 1980, to Summers et al.; and, U.S. Pat. No. 3,842,978 entitled "Process and Apparatus for Separating Sand from Botanical Materials" issued Oct. 22, 1974, to Summers.

In these inventions, the contaminated mixture (tobacco fines and sand) is dropped into a fluidized bed arrangement where it is supported by a grate. Air is drawn through the grate which causes the contaminated mixture to "bubble". The heavier sand falls through the grate. The bubbling action pulls a partially cleaned mixture of sand and fines up to a cyclone separator which performs a final cleaning of the mixture.

The final cleaning by the cyclone separator is necessary since it is this cyclone separator which provides the air draft to "suck" the partially cleaned mixture from the fluidized bed.

In these inventions, the use of the fluidized bed is required since the contaminated mixture must have a certain amount of dwell time within the separating mechanism. The dwell time within the bed is necessitated by the very nature of the cyclone separator which is extremely sensitive to many factors including the feed and exhaust tubing arrangement, physical damage to the input and exhaust ports, motor speed, variations in power source, etc.

A recent and more cost effective particle separation device is illustrated by U.S. Pat. No. 5,103,981 entitled "Particle Separator/Classification Mechanism" issued Apr. 14, 1992, to Abbott et al. This device separates particles using airflow to entrain and carry away lighter particles while heavier particles fall away. The entraining airflow is induced using an airflow amplifier powered by pressurized gas. While this separation device works well, it does not achieve complete separation of particles under all conditions.

It is clear from the foregoing that except for the expensive and delicate fluidized bed arrangements, an efficient inexpensive solution to the separation of particles which operates under all conditions does not exist.

SUMMARY OF INVENTION

The invention creates a system for cleaning or separating particles that uses a controller or computer to precisely control the cleaning or separating process. By carefully monitoring and controlling the separating process, an improved degree of separation is achieved.

In the preferred embodiment, the invention controls a particle separating machine which uses upward airflow in a channel to separate less dense particles from heavier or more dense particles. One such particle separator machine is described in U.S. Pat. No. 5,103,981 entitled "Particle Separator/Classification Mechanism" issued Apr. 14, 1992, to Abbott et al., incorporated hereinto by reference.

Upward airflow is induced in the channel by an airflow means. A wind speed sensor measures the air velocity in the channel and communicates this data to a controller. An operator inputs targeted or desired upward air velocity to the controller.

The controller commands the airflow means to increase or decrease airflow in the channel so that upward air velocity in the channel remains comparable to the targeted upward air velocity input from the operator. Particles entering the channel are separated to a very high accuracy because of the precisely controlled airflow.

The first significant feature of the invention is the controller. The controller continuously monitors and controls the particle separation machine so that optimum separation efficiency is achieved.

The controller receives data indicative of the actual air velocity in the channel. The controller then commands the airflow means to increase or decrease airflow in the channel to maintain the target air velocity in the channel.

A wind speed sensor measures air velocity in the channel. The wind speed sensor generates an air velocity signal indicative of the actual air velocity in the channel and communicates this signal to the controller. The controller uses this air velocity signal to determine if airflow in the channel needs to be increased or decreased.

Airflow in the channel is induced by an airflow means. In the preferred embodiment the airflow means is an airflow amplifier. Airflow amplifiers are devices which induce airflow by directing pressurized gas through a channel at high velocity. The high velocity pressurized gas moving through the channel induces an increased volume of air to move through the channel. Airflow amplifiers have no moving parts and are powered only by pressurized gas. Airflow amplifiers are precisely controlled by merely controlling the supply of pressurized gas to the airflow amplifier. Airflow amplifiers are described in detail below.

A gas pressure valve controls the supply of pressurized gas to the airflow amplifier. Gas pressure valves are commonly known in the art. Increasing the supply of pressurized gas to the airflow amplifier increases the power of the airflow amplifier and consequently increases airflow and air velocity in the channel. Similarly, decreasing the supply of pressurized gas to the airflow amplifier decreases the power of the airflow amplifier and consequently decreases airflow and air velocity in the channel.

A transducer enables the controller to control the gas pressure valve. Transducers are commonly known in the art. The transducer converts electrical signals from the controller into a correlated gas pressure. The correlated gas pressure in turn controls the gas pressure valve.

The preferred embodiment of the gas pressure valve and transducer are described in detail below.

The wind speed sensor, controller, transducer, gas pressure valve, and airflow amplifier comprise the principal components of the preferred embodiment of the invention. These components function together to precisely control air velocity in the channel.

The current invention allows particle separation machines to be significantly more efficient. There are several reasons for this increased efficiency. First, the invention allows the air velocity in a channel to be adjusted nearly instantaneously when the channel is totally or partially blocked. For example, when large amounts of particles are deposited into a channel at the same time, air velocity in the channel normally decreases because of the blockage. Consequently, the particles are not efficiently nor completely separated. The invention, however, quickly detects a decrease in air velocity and makes nearly instantaneous adjustments to increase the air velocity in the channel to the targeted velocity. Thus, the invention allows the particle separation machine to continue to efficiently separate particles even when large amounts of particles are placed in the channel.

Secondly, the invention allows the air velocity in the channel to be maintained when variations in the pressurized gas supply occur. Variations in the pressurized gas supply are common due to other loads on the pressurized gas and varying demands for the pressurized gas. Without the invention, variations or changes in the pressurized gas supply cause related variations in the airflow and air velocity in the channel. Any variations in the air velocity from the target air velocity cause the particle separation machine to be less efficient than possible.

The invention compensates nearly instantaneously for any variations in the pressurized gas supply. The invention quickly detects a reduced air velocity in the channel and makes nearly instantaneous adjustments to increase the air velocity in the channel. Similarly, the invention quickly detects an increased air velocity in the channel and makes nearly instantaneous adjustments to decrease the air velocity in the channel.

The current invention makes particle separation machines significantly more efficient. The significant features of the invention are illustrated in the figures and described more fully below.

BRIEF DESCRIPTION OF THE DRAWINGS

FIG. 5 is a chart of best air velocities for separating certain particles.

DETAILED DESCRIPTION OF THE DRAWINGS

Figure 1:
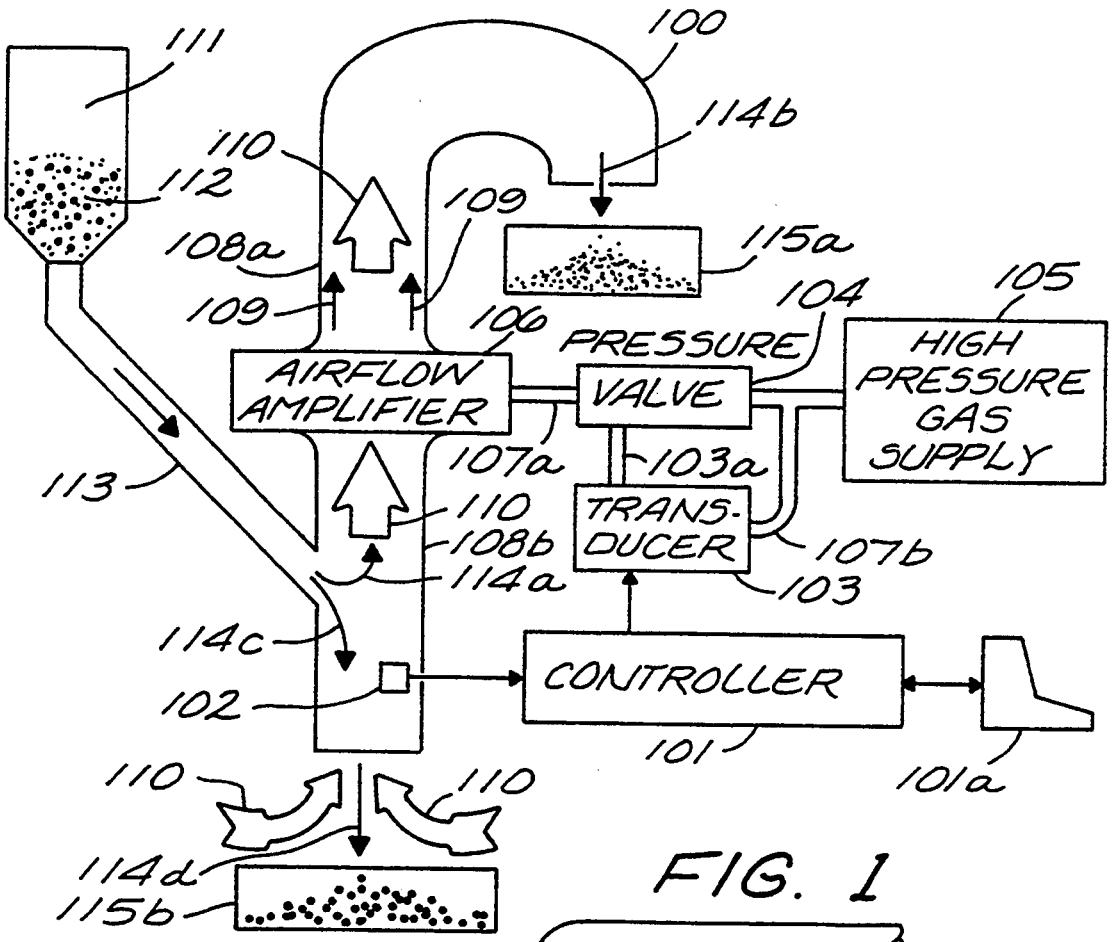
FIG. 1 shows the preferred embodiment of the invention controlling an airflow type particle separation machine.

FIG. 1 shows the preferred embodiment of the invention controlling an airflow type particle separation machine. Particle separation machine 100 is connected to controller 101, wind speed sensor 102, transducer 103, and pressure valve 104.

High pressure gas supply 105 supplies pressurized gas to particle separation machine 100. High pressure gas supply 105 is any type of pressurized gas supply capable of supplying a continuous supply of pressurized gas. High pressure gas supplies are commonly known in the art and include, but are not limited to, electric powered air compressors, gas engine powered air compressors, pressurized gas tanks, and the like.

The pressurized gas is any kind of gas suitable for this purpose including, but not limited to, air, oxygen, nitrogen, and the like.

Pressure valve 104 regulates the supply of pressurized gas from high pressure gas supply 105 to airflow amplifier 106. Pressure valves (sometimes referred to as pilot operated regulators) are commonly known in the art. A variety of suitable pressure valves are commonly available.

Pressurized gas is supplied to airflow amplifier 106 via gas supply line 107*a*. Airflow amplifier 106 directs the pressurized gas upward into channel 108*a* at high speed as shown by arrows 109. The pressurized gas flow induces airflow through channel 108*b* as shown by arrows 110.

Airflow amplifiers are well known in the art. Some examples are: U.S. Pat. No. 4,046,492, entitled "Air Flow Amplifier" issued Sep. 6, 1977, to Inglis; U.S. Pat. No. 4,385,728, entitled "Flow-Amplifying Nozzle" issued May 3, 1983, to Inglis et al.; and U.S. Pat. No. 4,195,780, entitled "Flow Amplifying Nozzle" issued Apr. 1, 1980, to Inglis (all of which are incorporated hereinto by reference). Commercially, airflow amplifiers of relatively high amplification ratio are available from Vortec Corporation and are referred to as "transvectors".

The key to an airflow amplifier is that it utilizes air or gas under high pressure. An airflow amplifier directs the high pressure air through an air channel in the direction of the desired airflow. As the high pressure air moves through the air channel, it naturally sucks or draws the heretofore static or ambient air along with it. This movement of air induces airflow in the air channel.

Because the resulting airflow is established by use of a relatively small amount of high pressure air, an air compressor easily establishes a source of high pressure air to operate the airflow amplifier without moving parts. Equivalent airflow means are commonly known in the art and include, but are not limited to, various types of fans, blowers, vacuums, and the like.

Air channel 108 is comprised of an upper channel 108*a*, which is above airflow amplifier 106, and a lower channel 108*b*, which is below airflow amplifier 106.

A feature of the preferred embodiment is that the upper channel 108*a* has a smaller diameter than the lower channel 108*b*. This feature causes a higher air velocity in the upper channel 108*a* and aids in transporting the light weight separated particles to container 115*a*. In the preferred embodiment, used for cleaning abrasive blasting media, upper channel 108*a* is six inches in diameter and lower channel 108*b* is seven inches in diameter.

Hopper 111 holds particles or media 112 to be separated. Particles or media 112 are transported to channel 108*b* by tube 113. As the particles enter the lower channel 108*b* they encounter upward airflow. Lighter or less dense particles are entrained by the upward airflow and move upward as shown by arrow 114*a*. The lighter or less dense particles are conveyed by the airflow up channel 108*a* and deposited into container 115*a*.

Heavier or more dense particles are not entrained by the airflow and drop out the bottom of channel 108*b* as shown by arrows 114*c* and 114*d*. These particles fall into container 115*b*.

Wind speed sensor 102 detects air velocity in the lower portion of channel 108*b* . Wind speed sensor 102 generates an air velocity signal indicative of the actual air velocity or wind speed in channel 108*b* . This air velocity signal is communicated to controller 101.

Wind speed sensors are commonly known in the art. Wind speed sensor 102 is any wind speed sensor capable of accurately measuring air velocity and generating a suitable air velocity signal. The preferred embodiment uses a Series 640 Air Velocity Transmitter manufactured by Dwyer Instruments, Inc., of Michigan City, Ind.

Controller 101 receives the air velocity signal from wind speed sensor 102. Controller 101 also receives operator inputs from operator interface 101*a*. The controller is a computer, microprocessor, microcontroller, electronic circuit, or the like with the necessary capabilities to perform control functions. Operator interface 101*a* is any suitable interface for receiving operator inputs, including, but not limited to, keyboards, consoles, control panels, data terminals, switches, and the like.

The preferred embodiment uses a series 1600 Temperature/Process Control device manufactured by Dwyer Instruments, Inc., of Michigan City, Ind., to handle the combined functions of the controller 101 and the operator interface 101*a*.

Controller 101 receives targeted air velocity data from operator interface 101*a*. Controller 101 compares the air velocity signal from wind speed sensor 102 with the targeted air velocity data from operator interface 101*a*. If the air velocity signal and the targeted air velocity data are not equal, controller 101 commands transducer 103 and pressure valve 104 to increase or decrease gas pressure as needed to return air velocity to the targeted velocity.

Controller 101 sends commands to transducer 103. Transducer 103 converts the controller's command into gas pressure. Transducer 103 is supplied with pressurized gas via gas supply line 107*b*. Transducer 103 communicates commands to pressure valve 104 via gas line 103*a*.

Pressure valve 104 and transducer 103 are described in detail below.

Figure 2:
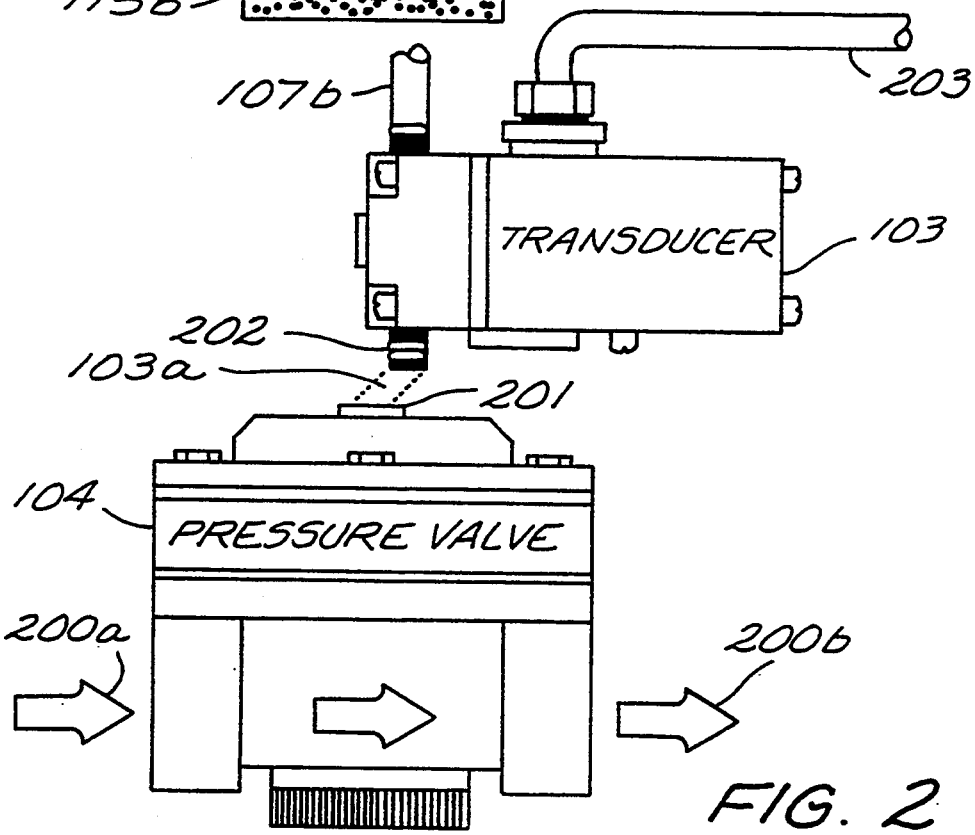
FIG. 2 shows the gas pressure valve and transducer assembly in detail.

FIG. 2 shows pressure valve 104 and transducer 103 in detail.

Pressure valve 104 regulates the supply of pressurized gas to the airflow amplifier (not shown). Pressure valve 104 (sometimes referred to as pilot operated regulators) are commonly known in the art. Pressurized gas enters pressure valve 104 as shown by arrow 200*a*. Regulated pressurized gas exits pressure valve 104 as shown by arrow 200*b*.

Pressure valve 104 is controlled via control port 201. Transducer output port 202 attaches to or is in communication with control port 201 via gas line 103*a*. Transducer 103 converts electrical signals from controller (not shown) into gas pressure by which pressure valve 104 is controlled. Cable 203 communicates pressure command signals from controller to transducer 103.

Transducer 103 is supplied with pressurized gas from high pressure gas supply (not shown). Pressurized gas is supplied to transducer 103 via gas supply line 107*b*.

Electrical to gas pressure transducers are commonly known in the art. The preferred embodiment, uses a Type 1000 Transducer produced by Bellofram of Newell, W. Va.

Figure 3:
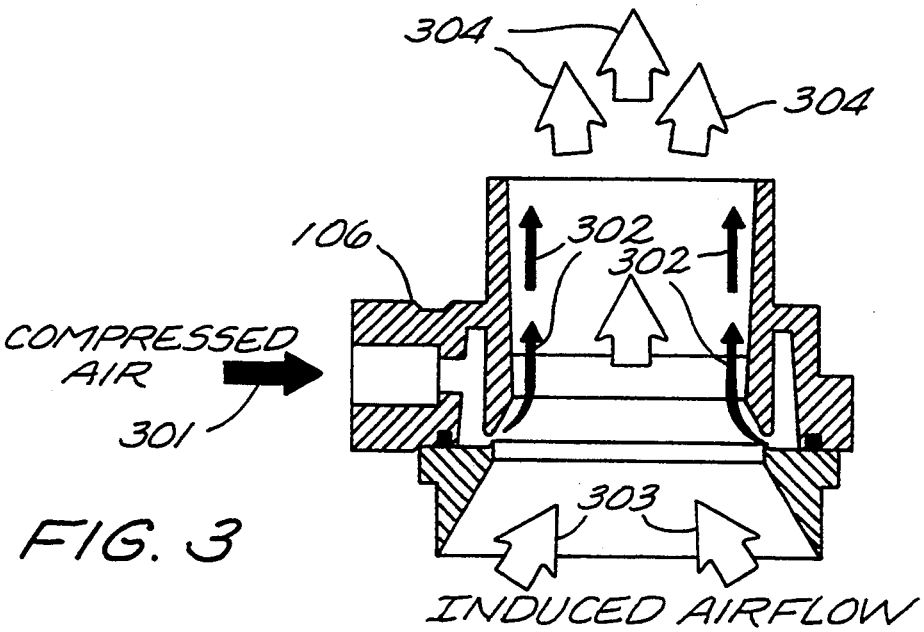
FIG. 3 shows a cutaway view of an airflow amplifier.

FIG. 3 shows an airflow amplifier 106 in detail. Compressed air 301 is supplied to the airflow amplifier 106. Arrows 302 represent compressed air directed through airflow amplifier 106. The compressed air "induces" the flow of a greater volume of air through airflow amplifier 106. Arrows 303 represent the induced airflow into the airflow amplifier 106. Arrows 304 represent the combined airflow of both the induced airflow 303 and the compressed airflow 302 leaving the airflow amplifier 106. The airflow amplifier 106 thus induces airflow as a fan would, but without any moving parts.

Figure 4:
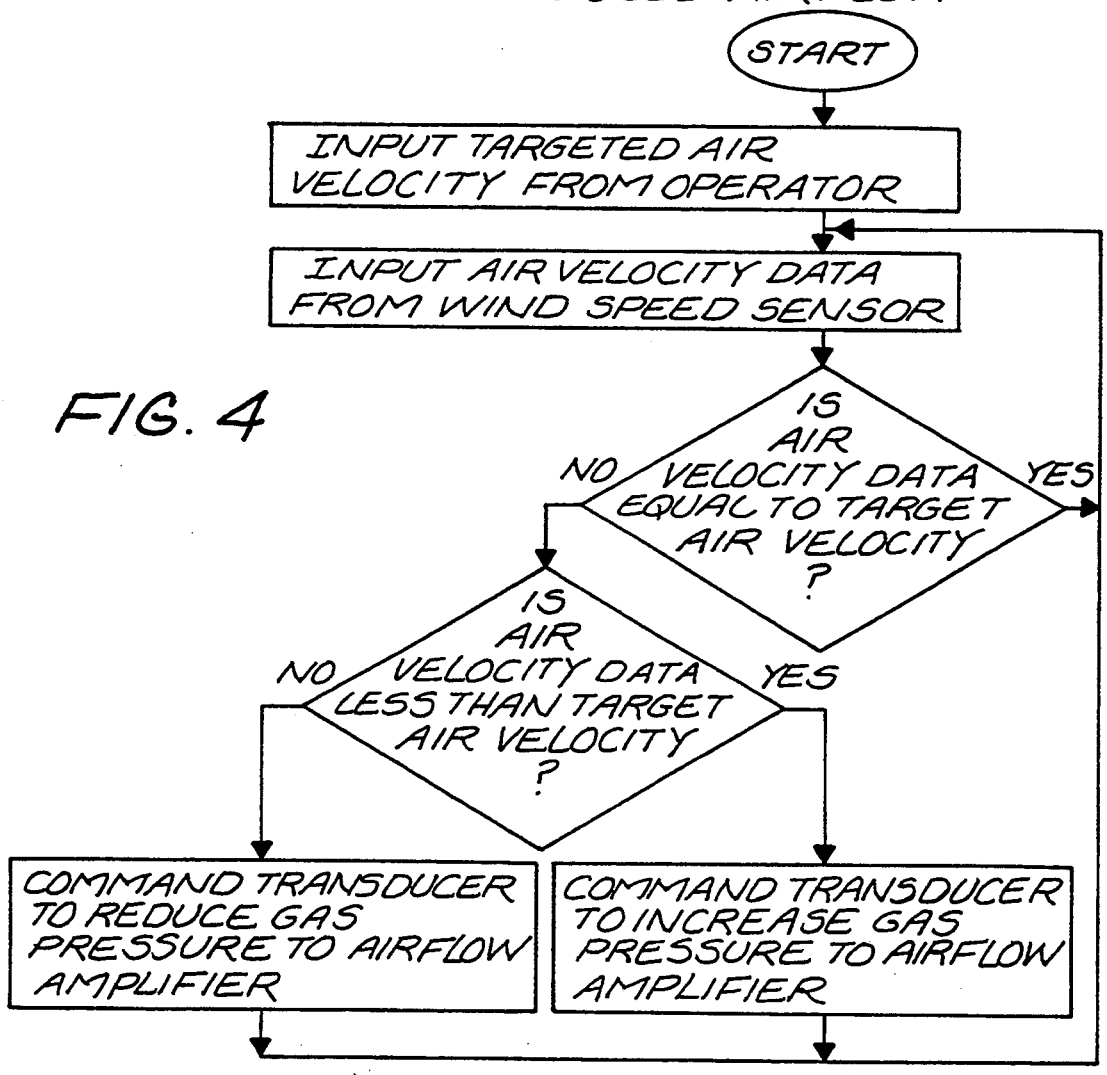
FIG. 4 shows a flowchart for the program in the controller.

FIG. 4 is a flowchart of a computer control program for the invention. This flowchart is a simplified flowchart demonstrating one implementation of a computer program for the invention. Those of ordinary skill in the art readily recognize equivalent flowcharts which perform substantially the same functions in substantially the same way.

Controller begins by receiving targeted wind speed or air velocity data from the operator. The flowchart then enters a repetitive loop which is a feedback control loop.

Next, the controller receives air velocity data from the wind speed sensor. The air velocity data is compared to the targeted air velocity data. If they are equal the flowchart loops back up to receive new air velocity data from the wind speed sensor.

If they are not equal then the air velocity data is tested to find whether it is less than the targeted air velocity. If it is less than the targeted air velocity the controller commands the transducer to increase gas pressure to the airflow amplifier.

Similarly, if it is greater than the targeted air velocity the controller commands the transducer to decrease gas pressure to the airflow amplifier.

The flowchart then loops back to receive new air velocity data from the wind speed sensor. This loop is continuously repeated to constantly monitor and control air velocity in the channel.

FIG. 5 is a chart of the best air velocities for separating certain size particles.

The best information currently available specifies an initial range of air velocities for separating certain size particles. The chart specifies particles according to mesh size and air velocity in feet per minute (FPM).

Larger particles, in the 20 to 25 mesh size, require higher air velocity to be entrained and separated by the upward air flow. Smaller particles, in the 38 to 50 mesh size, require lower air velocity to be entrained and separated by the upward air flow.

An operator uses the chart for the initial setting of air velocity. The operator then makes fine adjustments to the air velocity to achieve the desired separation of particles.

This specification describes the preferred embodiment of the invention. Those of ordinary skill in the art recognize equivalent embodiments which perform substantially the same function, in substantially the same way, to accomplish substantially the same result.

It is clear from the foregoing that the present invention represents a new and useful device for improving the performance of air powered particle separation machines.

What is claimed is:

1. A particle separator comprising:

a) a vertical tube having a first section and a second section, said first section positioned above said second section;

b) an airflow amplifier interposed between said first section and said second section of said vertical tube, said airflow amplifier creating a rising airflow in said vertical tube in response to high pressure gas;

c) air pressure means for selectively providing high pressure gas to said airflow amplifier;

d) wind speed sensor means for creating signals indicative of the speed of airflow in said second section of said vertical tube;

e) depositing means for depositing a mixture of a first group of materials and a heavier second group of materials in said second section of said vertical tube; and, f) control means for, 1) receiving, from an operator interface, targeted wind speed data indicative of a selected wind flow in said second section of said vertical tube, 2) receiving signals from said wind speed sensor means, and, 3) adjusting said air pressure means such that signals received from said wind speed sensor means correspond to said targeted wind speed data such that said first group of materials rises in said vertical tube while said second ground of materials falls in said vertical tube.

2. The particle separator according to claim 1 wherein said control means includes a computer.

3. The particle separator according to claim 2 wherein said control means further has means for, a) receiving, from an operator interface, particle type data indicative of the type of particle to be separated; and, b) calculating said targeted wind speed data based upon said particle type data.

4. The particle separator according to claim 3 wherein said first section of said vertical tube has a smaller diameter than said second section of said vertical tube.

5. An improved particle separation device comprising:

a) a vertical air channel having an upper channel and a lower channel, said upper channel directing airborne particles to a desired location, said lower channel directing falling particles to a receptacle;

b) an airflow means for producing an upward airflow in said air channel;

c) a particle delivery means for delivering particles into said air channel;

d) an airflow sensor means for generating an airflow signal indicative of actual airflow velocity in said air channel; and, e) control means for, 1) receiving said airflow signal from said airflow sensor means, 2) receiving targeted airflow data from an operator via an operator interface, and, 3) controlling said airflow means so that said airflow signal and said targeted airflow data are comparable and such that lighter particles in said air channel rise while heavier particles fall.

6. The improved particle separation device according to claim 5 wherein said control means continuously controls said airflow means so that said airflow signal and said airflow data remain comparable.

7. The improved particle separation device according to claim 6 wherein said airflow means comprises:

a) pressurized air supply means for supplying pressurized air; and, b) an airflow amplifier positioned between said upper channel of said vertical air channel and said lower channel of said vertical air channel, said airflow amplifier powered by said pressurized air.

8. The improved particle separation device according to claim 7 wherein said control means includes a computer.

9. The improved particle separation device according to claim 8 wherein said control means has further means for, a) receiving, from an operator interface, particle data indicative of the type of particle to be separated, and, b) calculating said targeted airflow data based upon said particle data.

10. The improved particle separation device according to claim 9 wherein said particle delivery means delivers said particles into said lower channel of said vertical air channel.

11. The improved particle separation device according to claim 10 wherein said upper channel has a smaller diameter than said lower channel.

12. The improved particle separation device according to claim 11 wherein said airflow signal is indicative of actual airflow velocity in said lower channel of said vertical air channel.

13. The improved particle separation device according to claim 12 wherein said particles comprise abrasive blasting media and debris from an abrasive blasting process.

14. A particle separating machine comprising:

a) a vertical tube having an upper section and a lower section;

b) an airflow means for inducing upward airflow in said vertical tube;

c) a particle delivery means for delivering particles to be separated into said vertical tube;

d) an airflow sensor means for generating an airflow signal indicative of actual airflow in said vertical tube;

e) computer means for, 1) receiving said airflow signal, 2) receiving, from an operator interface, particle data indicative of the type of particle to be separated, 3) calculating an optimal airflow in said vertical tube for separating said particles to be separated, 4) continually controlling said airflow means such that said actual airflow and said optimal airflow are comparable;

f) exhaust tube means in communication with said upper section for directing airborne particles to a recovery area;

g) a waste receptacle means below said lower section for holding falling particles from said lower section; and, h) a particle container means for holding said particles to be separated and for supplying said particles to be separated to said particle delivery means.

15. The particle separating machine according to claim 14 wherein said airflow means comprises:

a) pressurized air supply means for supplying pressurized air; and, b) an airflow amplifier positioned between said upper channel of said vertical air channel and said lower channel of said vertical air channel, said airflow amplifier powered by said pressurized air.

16. The particle separating machine according to claim 15 wherein said particle delivery means delivers said particles into said lower section of said vertical tube.

17. A method of separating particles comprising the steps of:

a) computing an optimal upward airflow in a vertical tube for separating particles;

b) inducing an upward airflow in said vertical tube;

c) measuring said upward airflow in said tube;

d) adjusting said upward airflow in said vertical tube so that said upward airflow is comparable with said optimal upward airflow;

e) introducing particles to be separated into said tube such that lighter particles become airborne; and, f) directing an airborne portion of said particles from the top of said vertical tube to a desired area.

18. A method of separating particles according to claim 17 further includes the step of providing a supply of pressurized gas and a means for regulating said pressurized gas, and wherein said step of inducing an upward airflow includes the step of inducing said upward airflow using an airflow amplifier powered by said pressurized gas.

* * * * *